United States Patent [19]

Graham

[11] Patent Number: 4,610,418

[45] Date of Patent: Sep. 9, 1986

[54] WALL MOUNTED SUPPORT DEVICE

[76] Inventor: Charles H. Graham, 7281 South 3100 West, Salt Lake City, Utah 84121

[21] Appl. No.: 619,817

[22] Filed: Jun. 12, 1984

[51] Int. Cl.[4] ..... A47G 1/24

[52] U.S. Cl. ..... 248/495

[58] Field of Search ..... 248/489, 495, 496, 497, 248/498, 476, 225.2, 224.3, 225.1, 220.2, 73, 548, 549, 479, 490–493

[56] References Cited

U.S. PATENT DOCUMENTS

| | | | |
|---|---|---|---|
| 340,165 | 4/1886 | Taxis | 248/496 |
| 913,125 | 2/1909 | Greene | 248/493 |
| 1,663,672 | 3/1928 | Therasse | 248/479 |
| 2,488,925 | 11/1949 | Miller | 248/495 |
| 2,657,887 | 11/1953 | White | 248/497 |
| 2,965,339 | 12/1960 | Denton | 248/495 |
| 3,955,790 | 5/1976 | Ballin | 248/489 |
| 4,437,639 | 3/1984 | Stein | 248/489 |
| 4,463,924 | 8/1984 | Conti | 248/492 |

FOREIGN PATENT DOCUMENTS

| | | | |
|---|---|---|---|
| 61116 | 7/1943 | Denmark | 248/477 |
| 477192 | 10/1969 | Switzerland | 248/497 |

*Primary Examiner*—Ramon S. Britts
*Assistant Examiner*—Alvin Chin-Shue
*Attorney, Agent, or Firm*—Trask, Britt & Rossa

[57] ABSTRACT

A support device for mounting objects on a wall includes a wall bracket and a hanger. The wall bracket is mounted on a wall by means of two openings, thereby preventing rotational movement of the bracket. The wall bracket also has an elongated stabilizer. The hanger includes a hanging notch and a separate centering notch, and is attached to the object to be hung. The hanger is engaged on the wall bracket by means of the hanging notch, while the centering notch straddles the stabilizer, thus counteracting rotational forces and maintaining the object spaced from the wall. The stabilizer also acts as a centering device which is adjustably bent until the desired orientation is obtained. The object can be removed and replaced with the same orientation by means of the adjusted stabilizer.

8 Claims, 8 Drawing Figures

Fig. 1
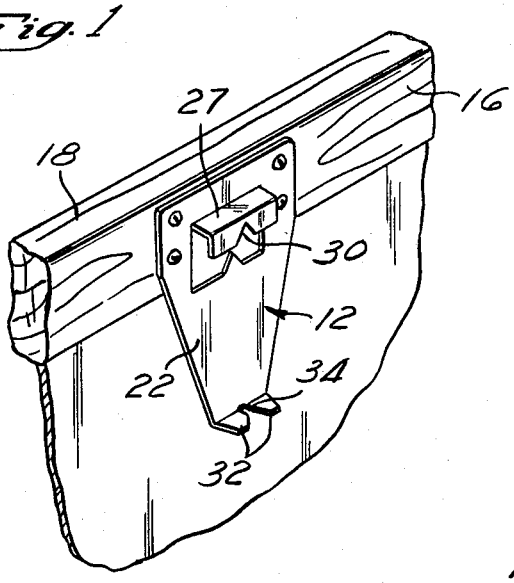
Fig. 2
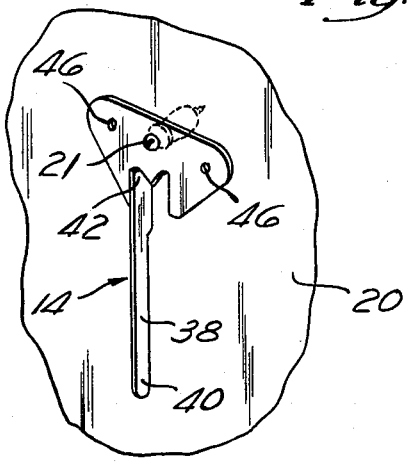
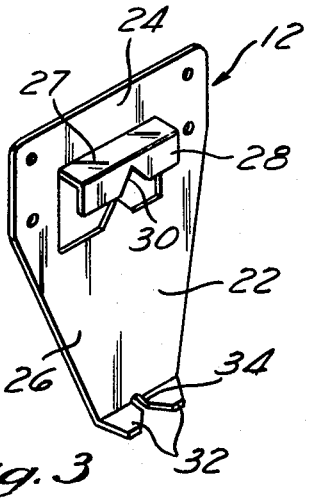
Fig. 3
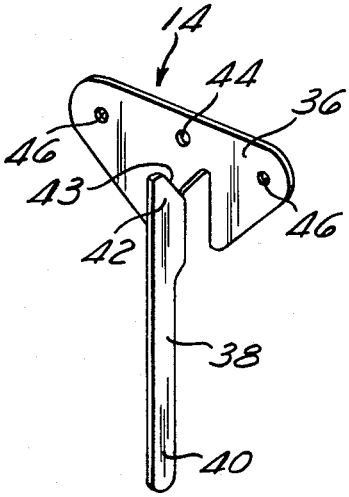
Fig. 4
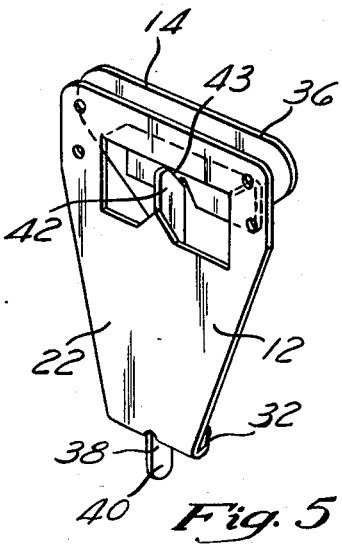
Fig. 5
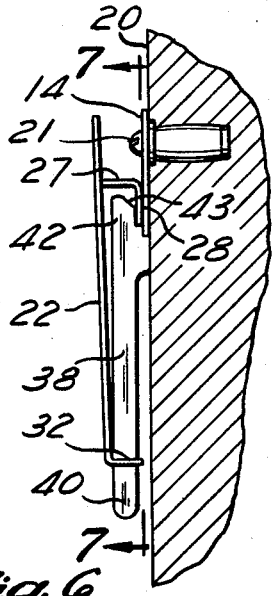
Fig. 6
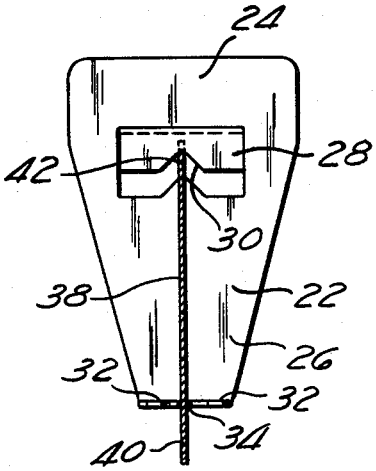
Fig. 7
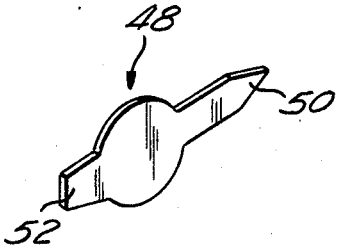
Fig. 8

WALL MOUNTED SUPPORT DEVICE

BACKGROUND OF THE INVENTION

This invention relates to a support device specifically for mounting or hanging an object on a wall or other substantially vertical surface. Present day support devices are generally of two types. The first type consists of two screw eyes, wire and a wall hook. The two screw eyes are positioned along the vertical sides of the object to be hung, such as the frame of a painting or photograph. Wire of sufficient length is threaded through the two screw eyes and attached on each end to a screw eye. The wall hook is then attached to the wall. To mount the picture on the wall the wire is placed over the wall hook. The picture is centered by moving the picture horizontally to a position where the center of gravity of the picture is vertically aligned with the wall hook. If the center of gravity is not directly below the wall hook, the force of gravity produces a moment acting about the wall hook, thereby causing the picture to rotate about that axis. The further the frame is from center, the greater the rotational force acting on the picture. The frame, for example, tilts as the center of gravity of the frame swings to a position where it is substantially below the wall hook. If the frame is positioned so that the center of gravity is close to being vertically below the wall hook, the rotational force will be small and can be counteracted by the friction between the wall and the bottom of the frame.

The second type of wall support device consists of a small sheet metal bar having a saw-toothed lower edge. The bar is attached over the center of gravity of the object with two fasteners. The wall hook, generally a nail, is placed into the wall, and the bar is hung on the nail. The object is moved horizontally from tooth to tooth until the center of gravity of the object to be hung is approximately below the nail or wall hook. Again, if the center of gravity is not vertically aligned with the wall hook, a rotational force results. This rotational force, if large enough to overcome the frictional force between the object and the wall, causes the object to tilt.

Shortcomings exist with both types of present day support devices. Both rely upon the friction force between the lower edge of the object to be hung and the wall to counteract any rotational force produced by improper alignment between the center of gravity of the object and the mounting axis of the wall support device. However, this friction force is fairly small and irregular. Both support devices can also be easily moved in a horizontal direction. These two factors result in instability in the positioning of the mounted object. Wind, vibrations in the wall, and other sources can cause the bottom of the frame to leave the wall momentarily, eliminating the friction force acting on the object. Any rotational force counteracted by the friction force will cause the object to tilt away from its horizontal or symmetrical position.

Another disadvantage in pre-existing support devices is that the vibrations in the wall can also cause the mounted objects to move horizontally. When this occurs, greater rotational forces will result. Moreover, with both types of prior art devices, the bottom edge of the hanging object contacts the wall or vertical surface. Rotational forces acting on the object will thus result in scratches and marks on the wall.

Furthermore, when both types of these devices are used, the picture or object angles out from the wall. Dust then gathers on the back of the frame resulting in additional clean-up when the picture is removed from the wall. In addition, when the object is rehung, the inconvenient and time-consuming process of leveling the picture must be repeated.

The toothed bar type of mounting device also has an additional problem when used to mount a small object. Because smaller pictures and frames weigh less, a smaller frictional force is generated. Thus, even a small rotational force cannot be counteracted and the picture will not hang level.

A further disadvantage associated with the wire, screw eye and wall hook arrangement, is that many times the wire is visible above the picture, which is, of course, quite unsightly.

SUMMARY OF THE INVENTION

Thus, it can be seen that there is a need for a wall mounted support device that has increased stability, that will not be subject to vibrational forces, and that will keep the object spaced from the wall. There is also a need for a wall support device which permits level hanging regardless of the position of the center of gravity, which can be easily adjusted for leveling and easily rehung. Finally, there is a need for a support device which is not visible after the picture is hung.

The wall mounted support device of the present invention cures the shortcomings discussed above. It is comprised of a wall bracket and a hanger. The wall bracket includes a wall plate and a stabilizing member. The wall plate has an opening for anchoring the wall bracket to the wall and a second opening for a fastener for counteracting rotational forces. The stabilizer is attached to the wall plate and extends substantially vertically from it. It is an elongated member having a hook on the upper end and a vertical deflection member, which is made of a ductile material which yields easily yet generally maintains its deformed shape while the object is hanging.

The hanger includes a plate and a hanging bar having a triangularly-shaped notch centered in the lower edge. Extending out from the lower end of the plate and perpendicular thereto are two feet which form a centering notch therebetween.

The hanger is attached approximately in the center of the upper edge of the object to be hung. The wall bracket is anchored to the wall through one opening. Another fastener is passed through the second opening and into the wall. The notch in the hanging bar of the hanger is placed over the hook on the wall bracket. The deflection member engages the centering notch at the bottom of the hanger. If the object is not level, the bottom edge of the object is moved to the right or left which bends the deflection member. The deflection member maintains this set position after the picture is leveled which keeps the picture square. The deflection member also counteracts any rotational force that exists. The deflection member transfers the rotational force through the wall plate to the second fastener in the wall, which completely reacts or counteracts it, far more efficiently than the frictional force relied on by prior devices. Thus, the object can be squared without having to go through the process of balancing the hanger on a hook as required in the prior art. The object is easily rehung, perfectly square, since it need only be engaged with the hanging notch and centering notch.

The object is further stabilized from horizontal movement since it is engaged at two points.

The centering notch in the hanger is dimensioned so that when engaged with the stabilizer on the wall bracket the picture remains substantially parallel to the wall. Thus, the bottom of the picture does not contact the wall, will not scratch or mark the surface of the wall, and will not accumulate dust. Furthermore, the wall bracket is mounted below the top edge of the object and therefore is not visible when hung.

BRIEF DESCRIPTION OF THE DRAWINGS

FIG. 1 is a perspective view of the hanger portion of the wall mounted support device of the present invention shown attached to an object, such as a picture frame.

FIG. 2 is a perspective view of the wall bracket mounted on a wall.

FIG. 3 is a close-up perspective view of the hanger similar to FIG. 1.

FIG. 4 is a close-up perspective view of the wall bracket similar to FIG. 2.

FIG. 5 is a perspective view of the hanger engaged with the wall bracket.

FIG. 6 is a side view of the wall hanger engaged on the wall bracket showing the wall in partial section.

FIG. 7 is a sectional view taken along line 7—7 of FIG. 6.

Fiugre 8 is a perspective view of the instrument used to mount the present invention.

DETAILED DESCRIPTION OF THE INVENTION

Referring to FIGS. 1 and 2, the wall mounted support device is comprised of a hanger 12 and a wall bracket 14. In FIG. 1 it can be seen that the hanger 12 is attached to an object 16, in this case a picture frame, to be hung on a wall or other planar surface 20. The hanger 12 is positioned on the back of the object 16 below the top edge 18.

With reference to FIG. 2, the wall bracket 14 is anchored to a wall 20 with an anchor bolt 21. The anchor can be one of a number of anchor bolts commonly available; however, preferably, a reusable anchor bolt as described in Applicant's Copending Application Ser. No. 609,484, filed May 11, 1984, which is incorporated by reference, is used.

Now referring to FIG. 3, the hanger 12 is comprised of a plate 22 having a rectangular top portion 24 and a trapezoidal bottom portion 26. Extending out at a right angle from the plate 22, proximate the top edge of the hanger 12, is a rectangularly-shaped support bar 27. One edge of the support bar 27 is attached to the plate 22 and the other edge is attached to a rectangularly-shaped hanging bar 28, whose plane is substantially parallel to the plane of the plate 22. Centered in the lower edge of the hanging bar 28 is a triangularly-shaped hanging notch 30, which is also substantially centered with respect to the plate 22. Extending out from the plate 22 and perpendicular to the lower portion 26 of the plate 22 are two feet 32 which are shaped so that a Y-shaped centering slot 34 is formed between them.

The plate 22 also has four openings located in the top portion 24 for mounting the hanger 12 to the back of the object 16 (See FIG. 1). The openings are placed close enough to the top edge of the hanger 12 that the hanger can be mounted below the top edge 18 of the object 16 and therefore not visible.

With reference to FIG. 4, the wall bracket 14 includes a wall plate 36 and a stabilizer 38. The wall plate 36 is essentially triangularly-shaped and has an opening 44 for mounting the wall bracket 14 on the wall or planar surface 20. Two other openings 46 are located in the wall plate 36 proximate its top edge.

The stabilizer 38 is a vertical, elongate device defining a plane substantially perpendicular to that of the wall 20, so that it extends out away from the wall. It is comprised of a hook 42 and a deflection member 40. The hook 42 is formed in the top edge 43 of the stabilizer 38 so that the edge 43 angles or slopes downward toward the wall plate 36. The lower, elongated rectangular portion of the stabilizer 38 is deflection member 40. It is made from a pliable semi-rigid, pliable material, such as metal, that can be manually manipulated or bent and will retain its new position.

The use and operation of the present invention will be described with reference to FIGS. 5, 6 and 7. Turning specifically to FIG. 5, the hanging notch 30 of the hanging bar 28 is shown resting on the lower-most portion of the hook 42 of the wall bracket 14, the slope of the edge 43 of the hook 42 and the force of gravity causing the hanging bar 28 to rest against the wall plate 36 of the wall bracket 14. The notch 30 transfers the weight of the object 16 and the hanger 12 to the wall bracket 14. The deflection member 40 is longer than the distance from the upper-most portion of the hanging notch 30 to the centering notch 34. Thus, as shown in FIG. 5, a portion of of the deflection member 40 extends below the the hanger 12 and engages the centering notch 34, as shown in FIGS. 6 and 7. When the deflection member 40 is positioned between the feet 32 and in the notch 34, the movement or rotation of the object 16 with respect to the wall 20 is prevented. Furthermore, the width of the stabilizer 38 is such that it holds the plate 22 and the object 16 out from the wall 20. The stabilizer 38 is dimensioned so that plate 22 of the hanger 12 is held out essentially parallel to the wall 20, therefore making the object 16 essentially parallel to the wall 20. The lower edge (not shown) of the object 16 does not contact the wall. As a result, there is no possibility of the lower edge of the hanging object 16 scratching or marking the wall 20.

When engaged, the hanging notch 30 transfers the weight of the object 16 and the hanger 12 to the wall bracket 14. The weight placed on the wall bracket is borne by the anchor bolt 21 in opening 44 and by the fastener (not shown) in one of the openings 46. The openings 46 and corresponding fasteners counteract rotational forces placed on the wall bracket 14. The hanging notch 30 of the hanger 12, therefore, does not have to be located in a precise vertical line over the center of gravity of the object 16. As explained above, when the hanger is not placed directly over the center of gravity, a rotational force is produced around the hanging notch 30. The direction of the rotational force produced is a function of the position of the hanger 12 relative to the center of gravity of the object 16. Depending upon the direction of the rotational force, one of the feet 32 forceably contacts the sides of the deflecting member 40, thus preventing the object 16 from tilting. The stabilizer 38 acts through the wall bracket 14 to react the rotational force on one of the fasteners in one of the openings 46. The fastener counteracts this rotational force.

If the object, in its equilibrium position, is not level, it can be easily adjusted by bending the deflection member 40. The deflection member 40 is sufficiently ductile so that it can be bent numerous times, and is also generally strong enough to maintain its orientation in counteracting rotational forces without bending. Of course, the holding strength of the deflection member 40 can be varied by using stronger or stiffer materials, or by varying its length.

In operation, the deflection member 40 is bent after engaging the hanger 12 with the wall bracket 14 by merely grasping the lower edge (not shown) of the object 16 and applying a force. Because the material used is ductile, the object or picture can be adjusted numerous times until square. Once oriented as desired, the object 16 can be removed and replaced without having to repeat the leveling procedure. The deflection member 40, as adjusted or bent, serves to mark the level position of the picture.

The placement of the hanger 12 along the top edge 18 of the object 16 is not extremely critical since the inventive wall support device can generally counteract any rotational forces produced. As a result, the person using the wall support device need only approximate the location of the center of gravity. Furthermore, the device 48 shown in FIG. 8 is used in mounting the wall bracket 14 on the wall 20 or other planar surface. It is comprised of a drill end 50, for producing an opening in the wall for the anchor 21, and a screw end 52 for installing the anchor. The device is mounted in the chuck of a hand drill for ease of use.

The invention may be embodied in other specific forms without departing from its spirit or essential characteristics. The described embodiment is considered in all respects only as illustrative and not restrictive and the scope of the invention is, therefore, indicative of the appended claims, rather than the foregoing description. All changes which come within the meaning and range of equivalency of the claims are to be embraced within their scope.

What is claimed is:

1. A support device for detachably mounting hangable object against a wall so that the support device is hidden from view by said object, comprising:

a first element having a mounting plate adapted for attachment to one of said object or wall in nonrotational relationship, including a stabilizer having an initial fixed rotational orientation and capable of being adjusted to selected fixed orientations rotated from said initial rotational orientation relative to said mounting plate; and a second element adapted for attachment to the other of said object or wall in nonrotational relationship, including means for coupling in rotational relationship with said first element to support said object from said wall and means for coupling with said stabilizer so that a fixed rotational orientation of said object with respect to said wall is adjustably determined by the rotational orientation of said stabilizer member.

2. A support device according to claim 1 wherein said first element mounting plate constituting means for fixing said first element to a planar surface, and said stabilizer includes an elongate deflection member of semi-rigid, yet bendable, material; and said second element includes means for effecting a pivot connection with said first element so that said second element may be pivoted about said pivot connection, thereby to adjust the rotational orientation of said second element with respect to said first element.

3. A support device according to claim 2 wherein said means for coupling with said stabilizer engages said deflection member so that when said second element is pivoted about said pivot connection, said deflection member is bent, thereby to establish a selected rotational orientation of said stabilizer different from its said initial fixed rotational orientation.

4. A support device according to claim 1 wherein:

said first element is a wall bracket mounted on a wall and the stabilizer is a vertical elongate member defining a plane substantially perpendicular to said wall with an upper edge constituting a hanger support surface and a depending deflection member; and said second element is a hanger including a plate fixed to a surface of a hangable object, structure projecting from the upper portion of said plate opposite said surface, carrying means for coupling with said hanger support surface and structure projecting from the lower portion of said plate opposite said surface, carrying means for coupling with a portion of said deflection member remote from said hanger support surface.

5. A support device according to claim 4 wherein said deflection member is constructed of a semi-rigid, pliable material capable of being manually manipulated from a first fixed orientation to a second fixed orientation.

6. A support device according to claim 5 wherein said deflection member and said hanger are cooperatively adapted to hold said surface of said object approximately parallel said wall when said hanger is coupled to said wall bracket.

7. A support device according to claim 5 wherein said structure projecting from the upper portion of said plate carries a notch configurated to receive said hanger support surface and said structure projecting from the lower portion of said plate carries a pair of legs arranged to straddle said deflection member.

8. A support device according to claim 7 wherein said hangable object is a picture frame, and said plate is fixed to the back surface of said frame.

* * * * *